US005336859A

United States Patent [19]

Wojtanek et al.

[11] Patent Number: 5,336,859

[45] Date of Patent: Aug. 9, 1994

[54] ILLUMINATED SWITCH

[75] Inventors: Guy A. Wojtanek, West Chicago; Jaime Lopez, Chicago; G. Scott Grafer, Huntley, all of Ill.

[73] Assignee: Eaton Corporation, Cleveland, Ohio

[21] Appl. No.: 40,722

[22] Filed: Apr. 1, 1993

[51] Int. Cl.[5] ..... H01H 9/16

[52] U.S. Cl. ..... 200/315; 200/562; 200/339; 200/DIG. 47; 29/622

[58] Field of Search ..... 200/310, 313, 315, 316, 200/311, DIG. 47, 562, 563, 339; 29/622

[56] References Cited

U.S. PATENT DOCUMENTS

| | | | |
|---|---|---|---|
| 3,482,542 | 12/1969 | Mace | 200/315 X |
| 4,013,857 | 3/1977 | Tanaka | 200/315 |
| 4,710,602 | 12/1987 | Baity et al. | 200/339 X |
| 4,778,966 | 10/1988 | Obata et al. | 200/310 X |
| 5,063,479 | 11/1991 | Satoh | 200/315 X |
| 5,095,409 | 3/1992 | Dematteo et al. | 200/315 X |
| 5,198,283 | 3/1993 | Hausler et al. | 200/310 X |

FOREIGN PATENT DOCUMENTS

| | | | |
|---|---|---|---|
| 319219 | 12/1989 | Japan | 200/310 |
| 2083708 | 3/1982 | United Kingdom | 200/315 |

*Primary Examiner*—Glenn T. Barrett
*Attorney, Agent, or Firm*—Roger A. Johnston

[57] ABSTRACT

An illuminated rocker switch having a transparent actuator in the form of a light pipe pivoted on the switch housing. The light pipe has a set of generally parallel spaced arms each transmitting light to a separate projection surface on each arm from the common edge of an aperture illuminated by a lamp. A separate arm receives light from a separate lamp at a second light receiving surface and transmits light to a projection surface on the end of the separate arm. An opaque actuator cover is attached to the light pipe and has transparent regions adjacent each projection surface for illumination. The cover has an opaque shroud tube received on the separate arm and shields it from illumination other than from its own lamp. The light pipe carries a shorting bar which, upon user movement of the actuator switches between stationary contacts on the housing.

11 Claims, 3 Drawing Sheets

ILLUMINATED SWITCH

BACKGROUND OF THE INVENTION

The present invention relates to switches of the type having a rocker or pivoted actuator which actuates a switching mechanism in response to user movement of the actuator in either a clockwise or counter-clockwise direction about the pivot. Rocker type switches have found particular application in accessory switches provided in motor vehicles where it is desirable to have the switch rocker provided with illuminated indicia of the switch function to facilitate nighttime location of the switch and actuation by the user. In particular, it has been desired to provide illuminated rocker switches for controlling such accessory functions as automotive door locks, power window lift motors, windshield wiper controls, hazard light switches, cruise controls, and electric window de-icers, to name a few of the functions for which rocker switches are suitable.

For certain vehicle accessory control switches, it has been desired to provide continuous illumination of the switch function indicia for nighttime vehicle operation to facilitate user location and actuation of the switch. It has further been desired to provide the rocker with a secondary illumination indicating the state of actuation of the switch for providing readily discernable indication to the user that the function has been either activated or is de-activated. An example of such an automotive rocker switch application is that of a cruise control master switch where it is desired to illuminate separate indicia on the switch actuator indicating where the user is to provide tactile force on the rocker for a desired state of actuation, and to provide a separate illumination when the switch has been actuated to activate the cruise control function. Such an arrangement is particularly desirable for the master or arming switch for the cruise control where the SET, RESUME, and ACCEL/DECEL switches are located elsewhere on the vehicle as, for example, on a steering column stalk or as separate buttons on the steering wheel.

It has thus been desired to provide a simple, yet reliable, rocker switch having illuminated indicia on the actuator and secondary illumination indicating the state of actuation in a manner which enables high volume mass production and yet provides for the switch having ease of assembly and a relatively low manufacturing cost.

SUMMARY OF THE INVENTION

The present invention provides a rocker-actuated switch having the rocker pivotally mounted on a housing with a movable shorting bar contact on the rocker for switching between a pair of stationary contacts provided on the interior of the housing. The rocker includes a light pipe formed of transparent plastic material having an aperture therethrough with the lamp received therein such that the edge or periphery of the aperture functions as a light receiving, or input, surface. The light pipe has at least one, and preferably three, main light-transmitting arms which transmit light from the aperture edge to individual light projection or transmitting surfaces provided respectively on the end of each arm. An auxiliary arm is formed on the light pipe and extends in generally spaced-parallel arrangement with the commonly illuminated arms, The auxiliary arm is separately illuminated at a light-receiving or input surface on the lower end thereof by a separate stationary auxiliary lamp provided on the housing which transmits light exclusively to an auxiliary projection surface provided on the end of the auxiliary arm.

The cover or user input button is received over the ends of the arms and has an opaque portion thereof shrouding the auxiliary arm to prevent spurious light from the lamp within the aperture from illuminating the auxiliary projection surface. The cover is formed of transparent material, and has the outer surface thereof covered with opaque material, with portions thereof removed in the regions of the ends of the various arms to provide thereon back lighted indicia in the region adjacent the end of each arm. Commonly illuminated light-emitting or projection surfaces provide for constantly illuminated function indicia; whereas, the region adjacent the end of the auxiliary arm provides for illumination of the switch function indicia when the switch is activated.

The present invention thus provides a unique low-cost technique for fabricating and assembling a rocker-type switch with the switch actuator region or zones illuminated by a light pipe from a single lamp, and with the switch actuation function illuminated on the actuator with a separate individual lamp. An opaque shroud on the actuator cover prevents light from the indicia lamp from reaching the projection surface on the auxiliary light pipe arm.

DETAILED DESCRIPTION

Figure 2:
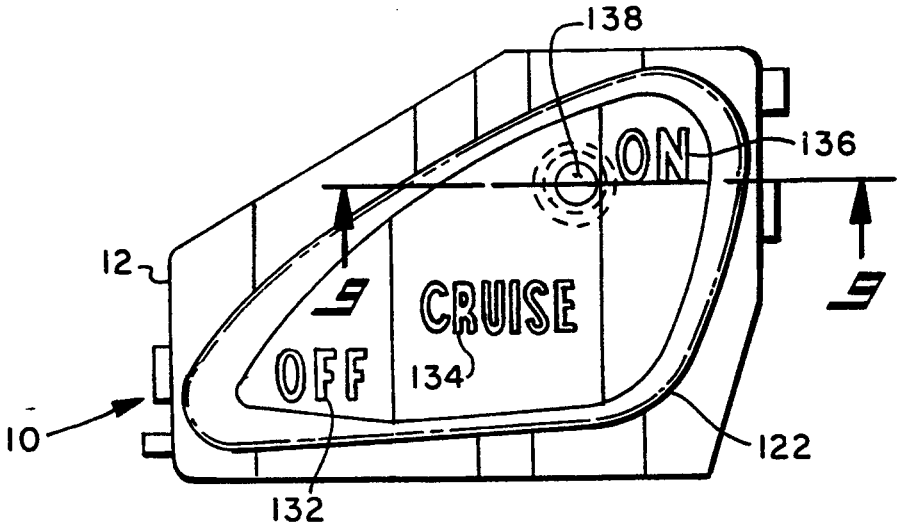
FIG. 2 is a top view of the switch assembly of FIG. 1.
Figure 1:
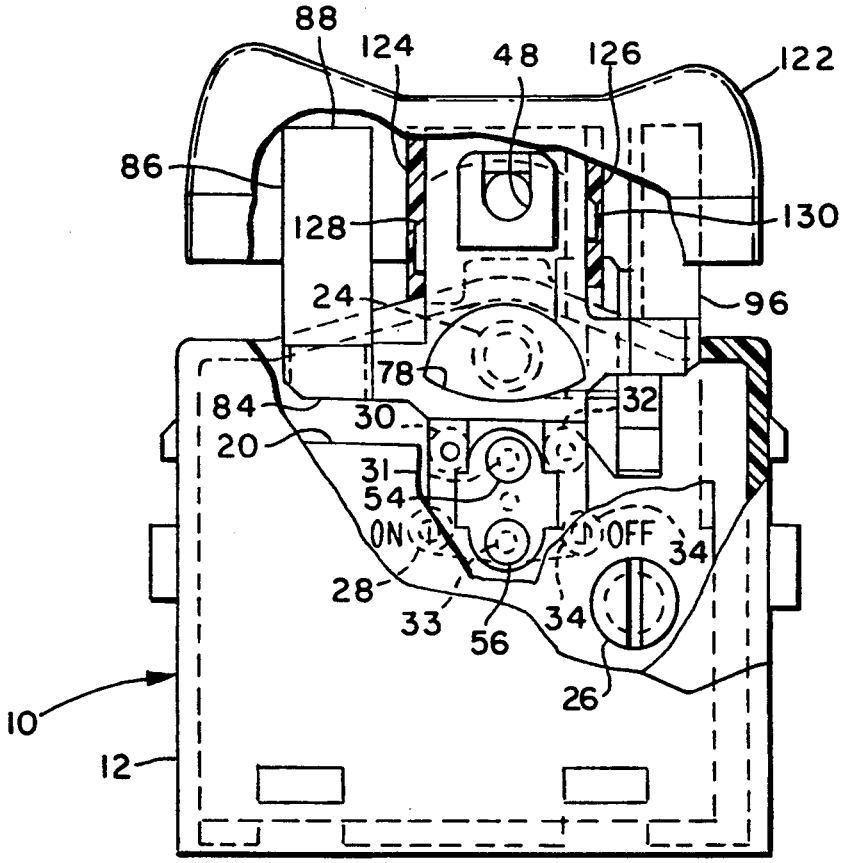
FIG. 1 is a front elevation view of the switch assembly of the present invention.

Referring to FIGS. 1, 2, 3, and 8, the switch assembly is indicated generally at 10 and has a housing 12 which has a plurality of electrical connector terminals, two of which are shown and denoted by reference numerals 14, 16 extending outwardly therefrom and surrounded by a protective wall or receptacle 18. In the presently preferred practice, the base with wall 18 is molded integrally and is preferably formed of plastic material. The connector terminals 14, 16 extend through the base and are attached to a circuit board 20 disposed vertically within the housing 12. Board 20 contains appropriate circuit functions, including a relay 22 and a first and second spaced lamp means denoted by reference numerals 24,26. The circuit board has provided thereon a first pair of spaced electrical contacts indicated in dashed outline and denoted by reference numerals 28,30, and which are connected for providing a switching function typically through relay 22.

If desired, a second pair of spaced contacts 32,34 may be provided in spaced relationship to the first pair, and both pairs may be configured to provide detent action. However, it will be understood that in the simplest form of the invention, only one pair of contacts 28,30 need be electrically functional. In the illustrated embodiment of the invention as a cruise control switch, a detented set of spaced center position contacts is employed, as denoted by reference numerals 31,33 and shown in dashed outline in FIG. 1.

The housing has provided on the upper end thereof a pair of upstanding stanchions denoted by reference numerals 36,38, which are disposed in generally spaced-parallel relationship. The stanchions 36,38 each have on the interior or adjacent faces thereof a projection or lug denoted, respectively, by reference numerals 40,42, which serve as assembly locators and pivot fulcrums.

A switch actuator sub-assembly indicated generally at 44 includes a light pipe indicated generally at 46, which has pockets or recesses provided on opposite sides thereof and denoted by reference numerals 48,50 into each of which is received, respectively, by snap engagement, one of the lugs 40,42 to thereby pivotally mount the assembly 44 onto the housing 12.

Actuator assembly 44 includes a shorting bar contact member 52, which has a pair of raised contact portions 54,56 spaced thereon to coincide with the spacing of contacts 28,30 and 32,34 and 31,33 on the circuit board for detent action and electrical contact therewith upon pivotal movement of the assembly 44. Shorting bar 52 has a pair of tabs 58,60 formed integrally therewith and extending therefrom in spaced parallel relationship and which are received in sliding engagement in correspondingly located slots 62,64 provided on a lower portion of the light pipe 46. A bias spring 66 has one end received in a blind bore 68 provided in the lower end of light pipe 46, which bore is also visible in FIGS. 4 and 7. The opposite end of spring 66 is registered against the rear face of shorting bar 52, and urges the contacts 54,56 into contact with the surface of the circuit board 20, making sliding contact with contacts 30,28,31,33, and 32,34.

Figure 3:
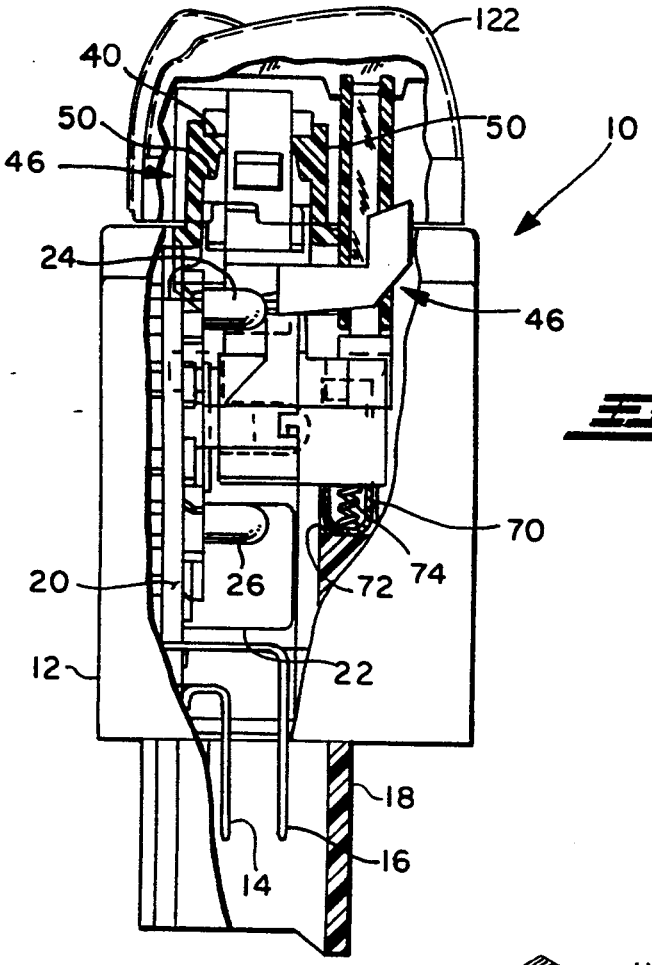
FIG. 3 is a right elevation view of the switch assembly of FIG. 1.
Figure 8:
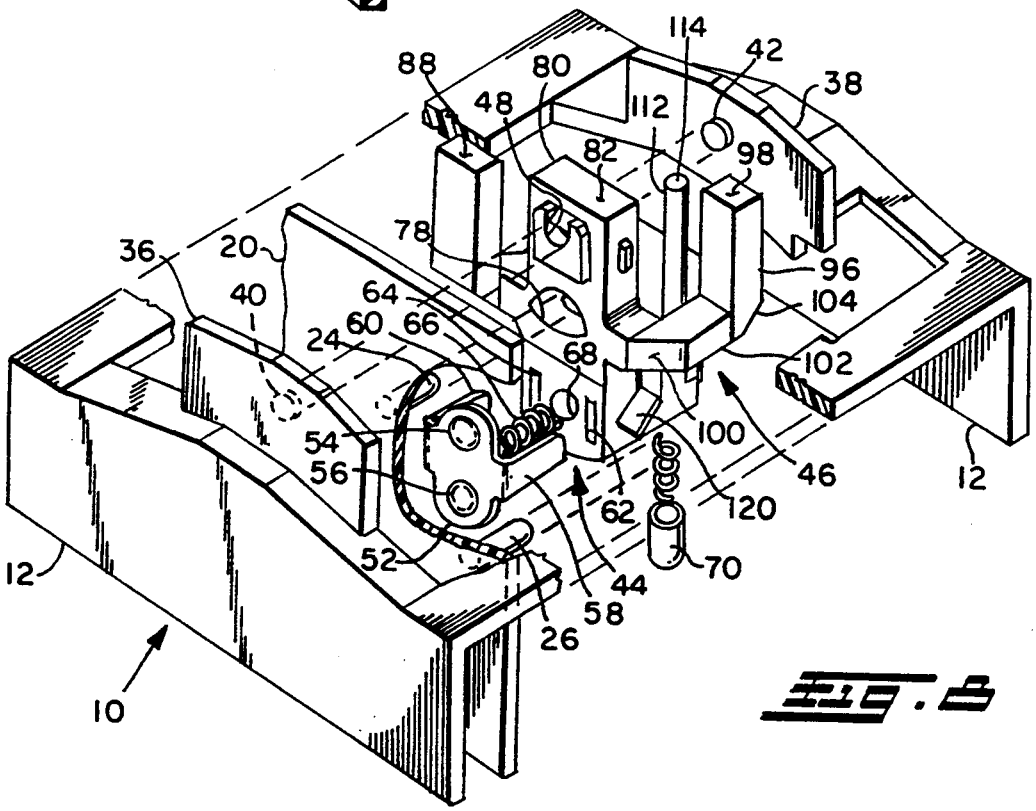
FIG. 8 is an exploded axonometric view of the upper portion of the switch assembly of FIG. 1, with the rocker cover removed; and, FIG. 9 is a section view, taken along section-indicating lines 9—9 of FIG. 2.
Figure 7:
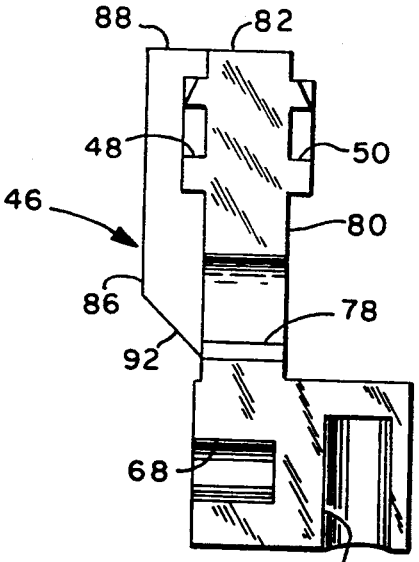
FIG. 7 is a section view, taken along section-indicating lines 7—7 of FIG. 4.

Referring now to FIGS. 3, 7, and 8, a detent plunger 70 extends downwardly into contact with a detent surface 72 provided in the housing where the urging of one end of a spring 74 which has the upper end thereof registered against the end of a blind bore 76 provided in the light pipe 46.

Referring to FIGS. 5 through 8, the light pipe 46 is formed as a unitary member of a suitable transparent plastic material. Light pipe 46 includes an aperture 78 having a generally half-moon configuration which is located directly below the pivot sockets 48,50 and extends transversely through the thickness of the light pipe, with the periphery or edge of the aperture 78 forming a common light input or receiving surface when illuminated by lamp 24, which at assembly extends into the aperture 78. The aperture is of sufficient width to accommodate the pivotal movement clockwise and counter-clockwise about the lugs 40,42 during user movement of the actuator assembly 44 for switching.

Figure 5:
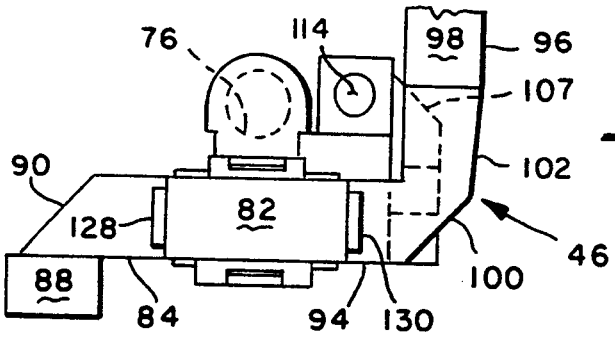
FIG. 5 is a plan or top view of the actuator of FIG. 4.
Figure 6:
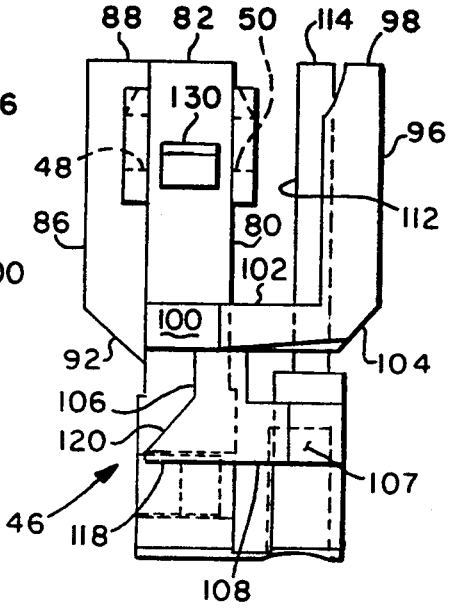
FIG. 6 is a right hand side elevation view of the actuator of FIG. 4.

Light pipe 46 has at least one arm portion 80 extending vertically upward from aperture 78, with a projection or output surface 82 formed on the upper end thereof. The pivotal mounting sockets 48,50 are formed on the front and rear face of arm portion 80. In the embodiment illustrated, the light pipe has a second arm extending outwardly from the left side of arm 80, with a horizontal portion 84 and a vertically upwardly-extending portion 86 which terminates at its upper end in a projection or light output surface 88. An inclined, polished surface 90 inclined in plan view as shown in FIG. 5 is provided at the end of the horizontally-extending arm portion 84. The vertical portion 86 of the arm has formed at its lower end a polished surface 92 inclined in elevation view, as shown in FIGS. 6 and 7. Thus, light received in the edge of aperture 78 and transmitted horizontally through arm portion 84 is reflected from surface 90 and onto surface 92, and is then reflected upwardly and transmitted through upwardly-extending arm portion 86 to the projection surface 88. It will be understood that light received in the upper portion of the periphery of the aperture 78 is transmitted by the main arm 80 directly upwardly to projection surface 82.

In the illustrated embodiment, the light pipe has a third arm extending on the opposite side of arm 80 from arm portion 84, and has a horizontally-extending portion 94 with a vertically-extending portion 96 attached thereto and which extends in generally spaced parallel relationship with central arm portion 80. Vertical arm portion 96 has a projection or light-transmitting surface 98 provided on the upper end thereof. Horizontal arm portion 94 has provided on the outer end thereof a polished reflecting surface 100 inclined in plan view as shown in FIG. 5; and, the right angle arm portion 102 connects arm portion 94 to the lower end of vertical arm portion 96. The rearward end of arm portion 102 has polished surface 104 inclined in elevation view as shown in FIG. 6 for reflecting light upwardly to be transmitted by vertical arm portion 96 to projection surface 98.

Figure 4:
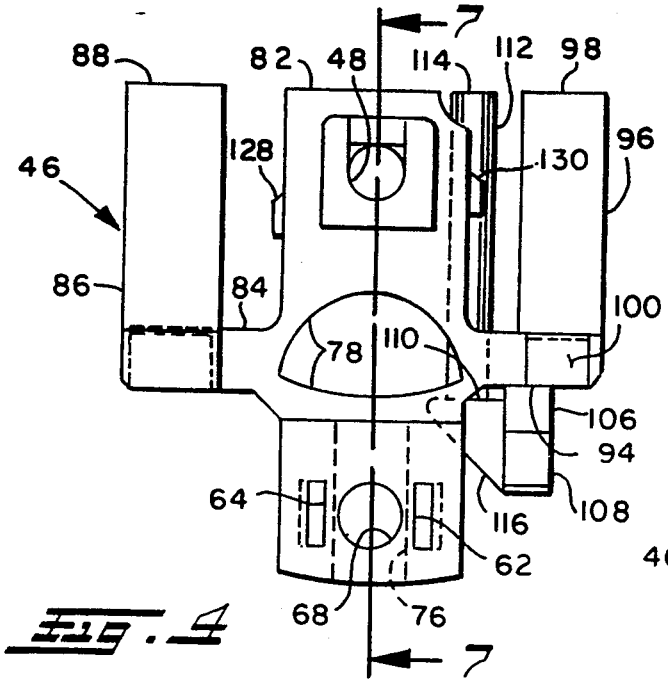
FIG. 4 is a front elevation view of the actuator of the switch of FIG. 1.

Arm portion 102 has extending vertically downwardly therefrom a support lug or post 106 formed integrally therewith, and which has attached to the end thereof an integrally formed, horizontally-extending arm 108 which extends in a direction generally parallel to the pivot axis of the actuator 44. Arm 108 has attached to the end thereof an inwardly-extending lug 110 as shown in FIG. 5 which has attached thereto and extending vertically-upwardly an auxiliary arm or rod member 112, which has a generally circular transverse configuration and terminates at its upper end in an auxiliary light projection or output surface 114. The end of lug 110 has provided thereon a polished surface 116 inclined to the vertical in front elevation as shown in FIG. 4, and which reflects light transmitted through lug 110 vertically-upwardly through rod 112 to auxiliary projection surface 114. It will be understood that horizontal arm 108 has a light input surface 118 provided adjacent on the front end thereof as the end opposite surface 100. Input surface 118 is disposed vertically directly above the lamp 26 at assembly and light received therein is reflected by a polished inclined surface 120, provided on the end of arm 108 adjacent the lug 106, which reflects light transmitted through arm 108 to the reflecting surface 107, which is inclined in plan view as shown in dashed line in FIG. 5, and solid outline in FIG. 6. Light reflects from surface 107 and is transmitted to surface 116.

The light pipe 46 is thus configured such that light from the single lamp 24 is transmitted to illuminate all of the individual projection surfaces 88,82,98. Light from lamp 26 is transmitted to illuminate only projection surface 114 on the rod 112. If desired for increased light projection, surfaces 88,82,98 may be slightly roughened or frosted.

Referring to FIGS. 1, 2, 3, and 9, actuator cover member 122 is received over the projection surface ends of the light pipe arms and secured thereto by suitable snap-action engagement by integral tabs 124,126 thereon engaging lugs 128,130 provided on arm 80 (see FIG. 4). The actuator cover 122 including tabs 124,126 is preferably formed of transparent plastic material, and has an outer coating of opaque material 128 provided thereover, and which is subsequently etched to have portions thereof removed to provide illuminated indicia such as those denoted by reference numerals 132,134,136 as shown in FIG. 2. The indicia 132 is located directly above projection surface 88, indicia 134 is located directly above projection surface 82 and indicia 136 is located directly above projection surface 98 on the light pipe.

Figure 9:
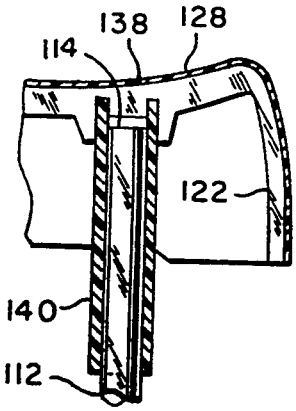

Referring to FIGS. 2 and 9, a separate illuminated portion or lens 138 is provided directly above the end of rod 112 for receiving light from projection surface 114, and the surface 138 is similarly formed by removing, as for example, by laser etching portions of the coating 128 adjacent the projection surface 114.

It will be understood, that in the simplest form of the invention, arms 86 and 96 may be omitted and illumination provided only to projection surface 82 by center arm 80 for backlighting indicia 134.

In the presently preferred practice, for a cruise control switch application, cover 122 is first coated with a layer of white enamel which is covered with a layer of black enamel. The black enamel is then laser-etched away to form the indicia 132,134,136, and lens 138 in white. It will be understood, however, for other switch applications different coatings and colors may be employed as well as other techniques for forming the indicia and lens.

Referring to FIG. 9, an opaque shroud in the form of a tube 140 has its upper end attached to the cover 122 secured thereto; and, the interior of tube 140 is received over the rod 112 in closely fitting relationship to the cylindrical rod 112. The opaque shroud 140 prevents rod 112 from receiving light from any source other than that transmitted vertically through the rod as reflected from inclined surface 116.

In the presently preferred practice, the actuator cover 122 is fabricated by inserting the opaque tube 140 in a die or mold and molding the transparent plastic material over the end of the tube 140, thereby securing the tube onto the cover 122 during molding.

In operation, and for a motor vehicle cruise control switch application, the lamp 24 is illuminated by the user turning on the vehicle instrument panel lamps commonly connected to the headlamp switch, whereupon indicia 132,134, and 136 are illuminated, it being understood that lamp 26 remains unlit. Upon the user pressing on the rocker actuator in the region of indicia 136, assembly 44 is pivoted to cause shorting bar contacts 54,56 to complete electrical connection between stationary contacts 30,28, and lamp 26 simultaneously provides illumination of projection surface 114 and the function indicating lens 138. In the present cruise control application, the circuitry and contact configuration is chosen such that lamp 26 and lens 138 remain illuminated when the user releases pressure on the rocker which returns to the center position with shorting bar contacts 52,54 contacting stationary center position contacts 31,33. When the user presses on the rocker in the region of indicia 132, the rocker is pivoted counterclockwise, causing the shorting bar to move to the position of detent contacts 32,34, whereupon lamp 26 is de-energized. Upon user release of the rocker, the actuator returns to the center and lamp 26 stays unlit. It will be understood that detent plunger 70, acting against detent surface 72 provides center position detenting of the rocker assembly 44.

The present invention thus provides a unique, low-cost rocker switch assembly which employs an integrally formed one-piece light pipe to illuminate from a common lamp plural indicia lenses on the switch actuator, and provides for separate illuminated indication of switch actuation from a second lamp illuminating separate portions of the integrally formed light pipe. A unique opaque shroud provided on the actuator cover for the transparent light pipe shields the portion of the light pipe conducting light from the second lamp to the actuation indicator lens.

Although the invention has hereinabove been described with respect to the illustrated embodiment, it will be understood that the invention is capable of modification and variation, and is limited only by the scope of the following claims.

We claim:

1. An illuminated switch assembly comprising:

(a) housing means;

(b) a switching mechanism disposed within said housing means and upon actuation and de-actuation adapted to effect opening and closing of a set of electrical contacts;

(c) actuator means mounted for pivotal movement on said housing means and operable upon user initiation of said pivotal movement to effect said actuation and de-actuation of said switching mechanism, said actuator means including a transparent means for piping light defining (i) a first light input surface operative for transmitting light to a plurality of individual main light output surfaces;

(ii) a second light input surface spaced from said first input surface and operative for transmitting light only to a secondary output surface; and, (d) a first light-emitting source associated with said housing means and disposed for illuminating said first input surface, and a second light-emitting source associated with said housing means and disposed for illuminating said second input surface.

2. The switch assembly defined in claim 1, wherein said actuator means has said light piping means formed as a unitary member and includes a back-lighted user contact surface disposed over said output surfaces.

3. The switch assembly as claimed in claim 1, wherein said actuator means includes a cover for said light piping means, said cover having illuminated indicia portions disposed adjacent each of said plural main output surfaces and an opaque light guide extending from said cover, said guide operative to shield portions of said light pipe guiding light to said secondary output surface for preventing illumination of said secondary output surface by said first light emitting source.

4. The switch assembly defined in claim 1, wherein said switching mechanisms includes at least one stationary contact mounted on said housing means and at least one movable contact mounted on said light piping means.

5. The switch mechanism defined in claim 1, wherein said switching assembly includes first and second stationary contacts on said housing means and a shorting contact on said light piping means.

6. The switch assembly defined in claim 1, wherein said light piping means includes a transparent rod portion intermediate said second input surface and said second output surface; and, said actuator means includes a cover with user contact surfaces thereon and having an opaque guide tube received over said rod portion for ensuring transmission of light to said second output surface.

7. The switch assembly defined in claim 1, wherein said light piping means includes a unitary member having plural main arms and at least one auxiliary arm disposed in spaced, generally parallel arrangement thereto with said main arms communicating with said first input surface and said auxiliary arm communicating with said second light emitting surface.

8. A method of making an illuminated switch comprising:

(a) providing a housing with a stationary switch contact and pivotally mounting thereon a transparent member having a movable contact and plural light receiving surfaces each transmitting through at least one separate discrete arm to a light projection surface;

(b) attaching an opaque actuator cover member to said transparent member and shrouding one of said member arms with portions of said actuator member for blocking spurious light from entering and leaving said one arm; and, (c) disposing a light source adjacent each of said light receiving surface and illuminating said surfaces independently.

9. The method defined in claim 8, wherein said step of shrouding includes inserting an opaque tube in a die or mold and molding said cover member onto said tube.

10. An illuminated switch assembly comprising:

(a) housing means including means defining a set of stationary switching contacts;

(b) a light pipe mounted for user pivotal movement on said housing means and having a movable contact thereon, said light pipe being user movable between first and second switching positions and operable in said first position to close said movable contact on said set of stationary contacts for completing a circuit therebetween and operable in said second position to open a circuit therebetween, said light pipe including a member having plural light receiving surfaces with at least one discrete arm portion for transmitting light from each of said receiving surfaces to a separate discrete projection surface;

(c) an opaque actuator cover means disposed on said light pipe and defining an illuminated area adjacent each of said projection surfaces, said cover means including an opaque shroud covering one of said light-transmitting arms; and, (d) light emitting means disposed adjacent each of said light receiving surfaces for independent illumination thereof, wherein said cover means is operative to ensure illumination of said one light transmitting arm by only one of said light emitting means.

11. The switch defined in claim 10, wherein said light pipe includes a transparent member having an aperture formed therein with one of said light emitting means disposed in said aperture.

* * * * *